United States Patent [19]

Sutherland

[11] 4,047,354

[45] Sept. 13, 1977

[54] COMPOSITE BEAM STRUCTURE

[75] Inventor: James Gordon Sutherland, Kingston, Canada

[73] Assignee: Alcan Aluminum Corporation, Cleveland, Ohio

[21] Appl. No.: 696,354

[22] Filed: June 15, 1976

[51] Int. Cl.[2] ..... E04C 3/32; E04C 3/07

[52] U.S. Cl. ..... 52/729; 52/730; 29/155 R

[58] Field of Search ..... 29/155 R, 510, 514, 29/521; 52/618, 625, 729–732

[56] References Cited

U.S. PATENT DOCUMENTS

| | | | |
|---|---|---|---|
| 1,053,487 | 2/1913 | Flatau | 29/521 |
| 1,421,146 | 6/1922 | Barrows | 52/625 |
| 1,421,280 | 6/1922 | Mayrow | 52/730 |
| 2,125,692 | 8/1938 | Ragsdale et al. | 29/155 R |
| 3,789,563 | 2/1974 | Toti | 29/155 R |

*Primary Examiner*—James L. Ridgill, Jr.

*Attorney, Agent, or Firm*—Cooper, Dunham, Clark, Griffin & Moran

[57] ABSTRACT

This composite beam structure is built up from at least two relatively rigid members, which may be of extruded aluminum and at least one relatively flexible web, which may be corrugated sheet aluminum. The web connects the relatively rigid members. The web has relatively short pitch, shallow corrugations in its margins to facilitate its connection to the rigid members, and relatively long pitch, deep corrugations between its margins to provide increased stress resistance. A box beam modification uses two relatively rigid members and two corrugated webs.

16 Claims, 18 Drawing Figures

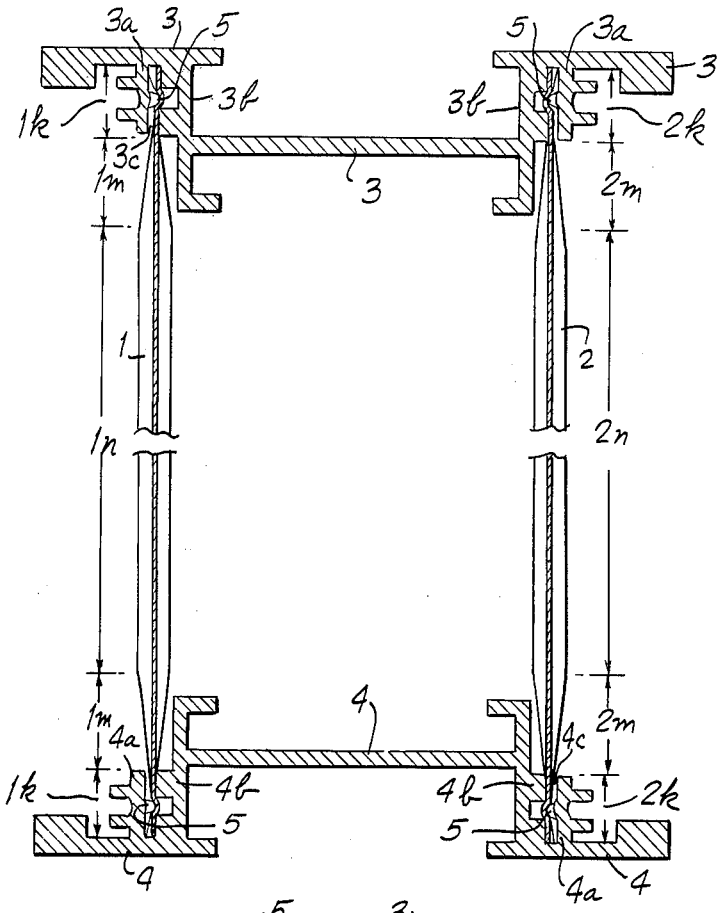
Fig. 4.
Fig. 5.
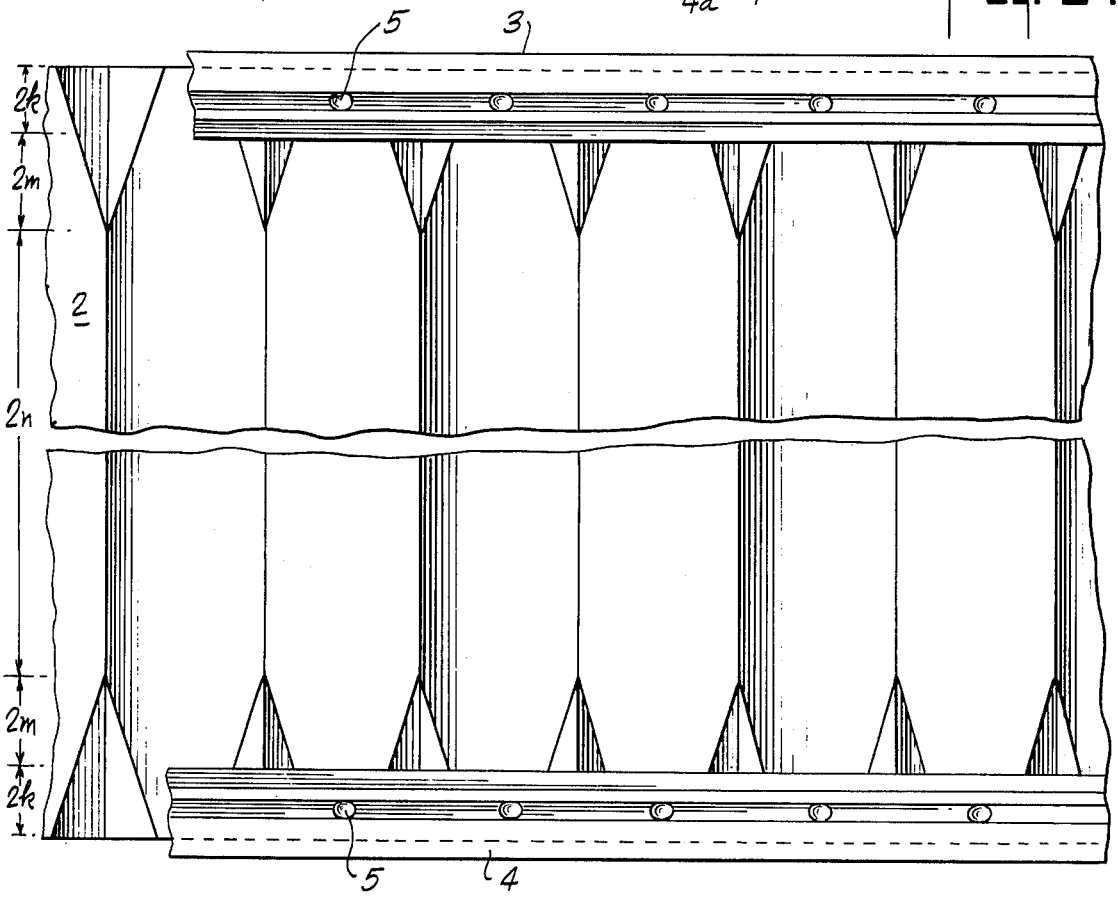

COMPOSITE BEAM STRUCTURE

CROSS REFERENCES

The beam of the present invention may be constructed by the use of apparatus shown and claimed in the U.S. patent to Andrew J. Toti, U.S. Pat. No. 3,840,960, dated Oct. 14, 1974 and by the method shown and claimed in Toti U.S. Pat. No. 3,722,052, dated Mar. 27, 1973.

BRIEF SUMMARY

The Toti patents show a beam of hollow rectangular cross-section, which is built up of two extruded members and two panels, which may be either flat or corrugated. Each extruded member is formed on its opposite sides with slots adapted to receive margins of adjacent panels. After a panel margin is inserted in a slot, spaced localities of one side of the slot are deformed and forced together with adjacent portions of the inserted panel, into a recess formed in the surface at the opposite side of the slot, so that the panel is gripped firmly between the sides of the slot.

The beams of the present invention are improved over the beams shown in the Toti patent with respect to the contour of the corrugations of the webs. It is desirable to make the corrugations as deep as possible, because the stress resistance of a corrugated web is known to increase with the depth of the corrugations, which have the effect of increasing the moment of inertia of the cross-section and also the radius of gyration of that cross-section. The method of assembly shown in the Toti patents limits the depth of corrugations which can be used, since the margin of the corrugated web is required to fit into a slot. The depth of the corrugations is limited by the width of the slot. The present invention uses a beam in which the web strength is increased by using deeper, longer pitch corrugations of the web in the middle part between the margins, where it is not fastened to the extruded member, and shallower, shorter pitch corrugations in the margins, so that the margins may fit conveniently into the slots of the extruded members, without requiring the slots to be wide enough to accommodate the deep corrugations of the middle part of the web. The present invention is applicable to beams using other means of fastening the webs in the slots, such as stapling, riveting or bonding.

The term "corrugation" as used in this specification, is intended to mean one full pitch, e.g., peak-to-peak or valley-to-valley. The term "fold" is intended to be generic to "peak" and "valley". Although angular folds are shown, for ease of illustration, it should be obvious that the invention is equally applicable to curved folds and corrugations. The term "primary" refers to the deeper, longer pitch corrugations at the middle of the web, while the term "secondary" refers to the shallower, shorter pitch corrugations at the margins.

The present invention achieves this change in depth and pitch between the middle and the margin of the web, as described above, by inverting certain ridges at the margin to form valleys, and/or by inverting certain valleys to form ridges. This can be done not only with the primary ridges or valleys but the secondary or higher order ridges or valleys can be similarly modified to form further ridges and valleys.

The folds of the shallower corrugations branch from the folds of at least some of the deeper (either primary or higher order) corrugations in groups, each including a central shallower fold opposite in contour from the deeper fold, and two diverging shallower folds similar in contour to the deeper fold. All of the folds of each set of shallower corrugations extend from folds of a deeper corrugation toward, and in some cases beyond, the median plane of the corrugated web.

The primary corrugations may be of uniform pitch and depth, as is conventional with sheet metal corrugations, although the present invention does not require such uniformity. The secondary corrugations should be of uniform depth and pitch, as measured at the edge of the web, for optimum results, although neither their pitch nor their depth has to be uniform. In fact, their pitch and depth vary transversely of the web in each of the embodiments illustrated.

The primary corrugations may be symmetrical with respect to a median plane, as is conventional with most, but not all sheet metal corrugations. Again, the present invention does not require such symmetry The secondary corrugations as they appear at the edge of the web, are preferably symmetrical with respect to the same median plane as the primary corrugations, but they may be symmetrical with respect to some other parallel plane, or they need not by symmetrical.

In those embodiments of the invention using secondary corrugations of uniform pitch and depth, the secondary corrugations are symmetrical with respect to a median plane, and the pitch of the deep middle corrugations is equal to a multiple of the pitch of the shallow corrugations as measured at the edges of the web. Also, the depth of the deep corrugations is substantially the same multiple of the depth of the shallow corrugations: the depth would be exactly the same multiple except for the effect of the thickness of the web material. The median plane of the secondary corrugations coincides with the median plane of the primary corrugations if the primary pitch is made an odd multiple of the secondary pitch.

Corrugations as described above may be formed in the web by a gear press or a reciprocating press, with only bending of the web material, and without producing significant stretching in the central plane of any part of the web material. The "central plane" of the web material is a plane which lies parallel to, and midway between, the surfaces of the web material.

DRAWINGS

FIG. 4 is a cross-sectional view of a composite hollow rectangular beam constructed in accordance with the invention.

FIG. 5 is a side view of the beam of FIG. 4.

DETAILED DESCRIPTION

FIGS. 1-3

Figure 1:
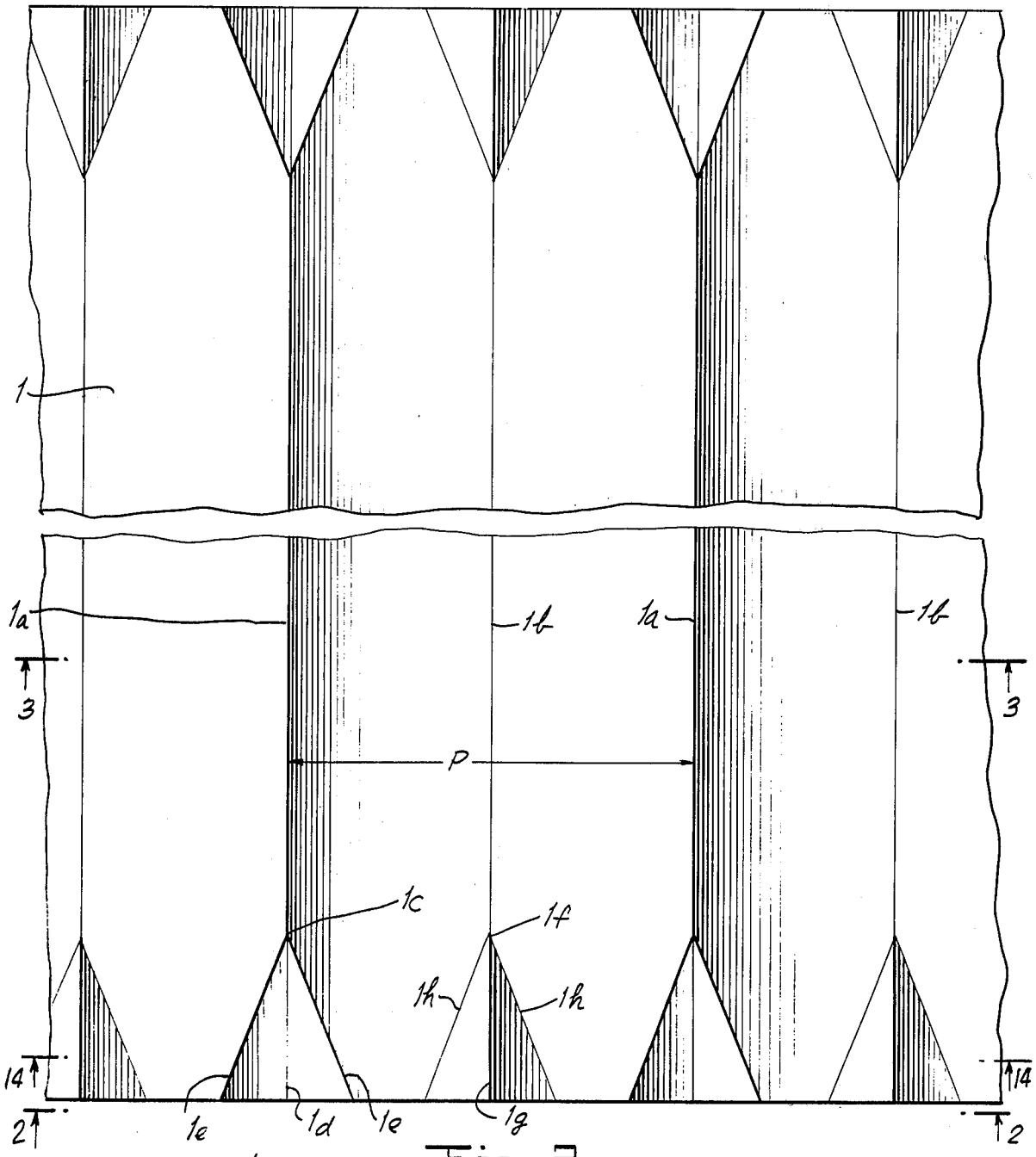
FIG. 1 is a plan view of a corrugated web suitable for use in a beam constructed in accordance with the invention.

These figures show a sheet 1 of metal, for example, aluminum, including deep middle corrugations comprising ridges 1*a* and valleys 1*b*. While planar surfaces are shown in the corrugated web 1 for use of illustration, it should be obvious that the invention is equally applicable to sinusoidal corrugations or other curved contours. Also, while sharp ridges and valleys have been shown for convenience in making the drawing, any practical structure will have at least a short radius of curvature at each ridge and valley.

Each ridge 1*a* branches at a point 1*c* into a central valley 1*d*, aligned with the ridge 1*a*, and two diverging ridges 1*e*. The valley 1*d* and both the ridges 1*e* extend downwardly from the peak of the ridge 1*a* toward the median plane 9 of the web 1. The valley 1*d* extends below that plane, as viewed in FIG. 2.

Similarly, each valley 1*b* branches to a point 1*f* into a central ridge 1*g*, aligned with the valley 1*b*, and a pair of diverging valleys 1*h*. The ridge 1*g* and the valleys 1*h* extend upwardly from the point 1*f* toward the median plane 9 of the web. The ridge 1*g* extends above that plane, as viewed in FIG. 2.

The deep corrugations have uniform pitch P and uniform depth D, and they are symmetrical with respect to the median plane 9. The shallow corrugations, as they appear at the edge of the web, have a uniform pitch *p* and a uniform depth *d*, and they are symmetrical with respect to the same plane 9.

The pitch P from ridge-to-ridge of the deep corrugations 1*a*-1*b*-1*a*, is three times the pitch *p* of the shallow corrugations 1*e*-1*d*-1*e*, and 1*h*-1*g*-1*h* as that latter pitch is measured at the edge of the web 1.

The ridge-to-valley depth D of the deep corrugations 1*a*-1*b*-1*a*, is approximately three times the ridge-to-valley depth *d* of the shallow corrugations as measured at the edge of the web. The depth *d* of the shallow corrugations should be as small as practicable in order to facilitate insertion of the web into a slot in the construction of a beam. It is desired to keep the width of the slot to a minimum.

In order to secure uniform pitch P and depth D of the deep corrugations and uniform pitch *p* and depth *d* of the shallow corrugations, as measured at the edge of the web, then P and D must be the same whole number multiple of *p* and *d*, respectively. Furthermore, if the shallow corrugations, as viewed at the edge of the web, are to be symmetrical with respect to the same median plane as the deep corrugations, then that whole number multiple must be an odd multiple.

For a given depth of the large corrugations, the depth of the small corrugations may be designed to be as small as necessary by dividing the depth and pitch of the large corrugations by a sufficiently large integer. Practical considerations relating to forming, tooling and web depths as well as structural behavior of the web are important to the choice of the best ratio of primary pitch to secondary pitch for a particular application. In the structure shown in FIGS. 1-3, this pitch ratio is 3:1. The forming of the corrugations in this case is relatively simple. Nevertheless, the difference in depth between the middle area and the margins of the web is appreciable. Furthermore, the bending strength of the middle area is significantly greater than the bending strength of the margins.

FIGS. 4-5

These figures illustrate a composite beam including two webs 1 and 2 inserted into slots 3*c*, 4*c* formed in extruded structural members 3 and 4, and locked therein by deforming, as shown at 5, legs 3*a*, 4*a* of the structural members and portions of the margins 1*k* and 2*k* of the webs 1 and 2 into recesses in walls 3*b*, 4*b*. The webs 1 and 2, and the members 3 and 4, may all be aluminum.

Each of the webs 1 and 2 has two margins 1*k* and 2*k*, two transitional regions 1*m*, 2*m*, and a middle region 1*n*, 2*n*. The margins 1*k*, 2*k* fit into the slots between the legs 3*a*, 4*a* and the walls 3*b*, 4*b*. The middle regions 1*n*, 2*n* are the deeply corrugated parts of the webs 1 and 2 and the transitional regions 1*m* and 2*m* are those which connect the margins 1*k*, 2*k*, to the central regions 1*n*, 2*n*.

The margins 1*k*, 2*k*, with their shallow corrugations, should be made wide enough so that the edges of the web reach the bottoms of the slots of the extruded members 3 and 4, it being borne in mind that the depth of the shallow corrugations increases from the edge of the web toward its center, and must be shallow enough at the sides of the margins farthest from the edge, so that the margins will be completely received in the slots in the structural member 3 or 4.

The transitional regions 1*m*, 2*m* should be made as narrow as conveniently possible, since they detract somewhat from the stiffness of the web, inasmuch as their corrugations are necessarily shallower than the deep corrugations 1*a*, 1*b* in the middle regions 1*n*, 2*n* of the web.

FIGS. 6-7

Figure 2:
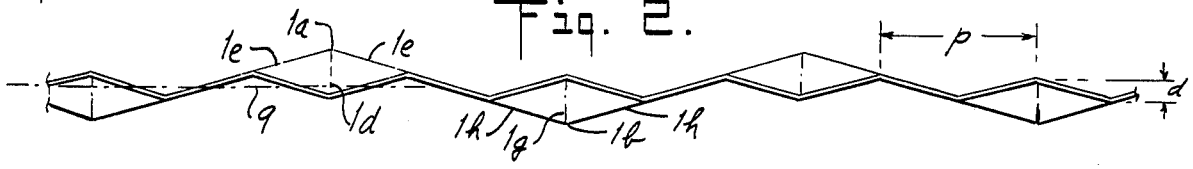
FIG. 2 is a elevational view of the web of FIG. 1, taken on the line 2—2 of that figure.
Figure 3:
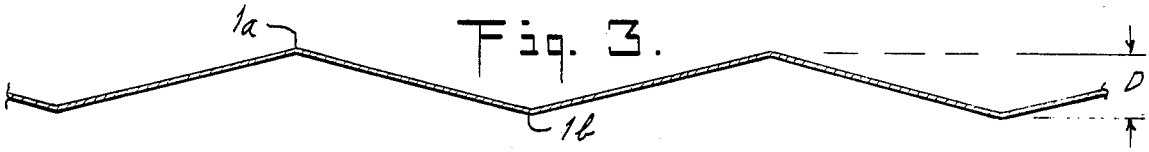
FIG. 3 is a cross-sectional view taken on the line 3—3 of FIG. 1.

These figures show a beam comprising a single web 6 constructed similarly to the web 1 of FIGS. 1-3 and two extruded structural members 7 formed with a slot into which the margins of the web 6 are inserted, after which a wall of the slot and the web margin are deformed as shown at 8. In this type of beam, the slot which receives the web 6 is substantially on the center line of the structural member 7. In other words, the structural member 7 generally has similar cross-sectional areas of material located on both sides of the web 7 in order to minimize the tendency to twist or bend the web by uneven loading.

FIG. 8

Figure 6:
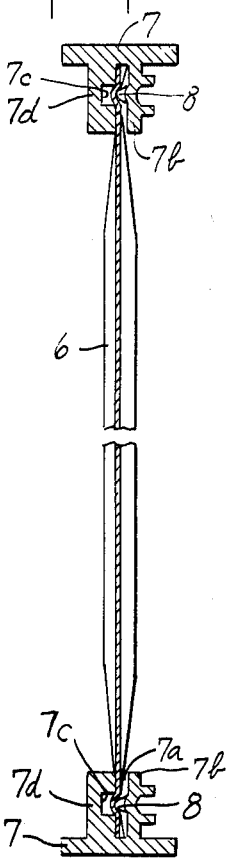
FIG. 6 is a cross-sectional view showing an I-beam constructed in accordance with the invention.
Figure 7:
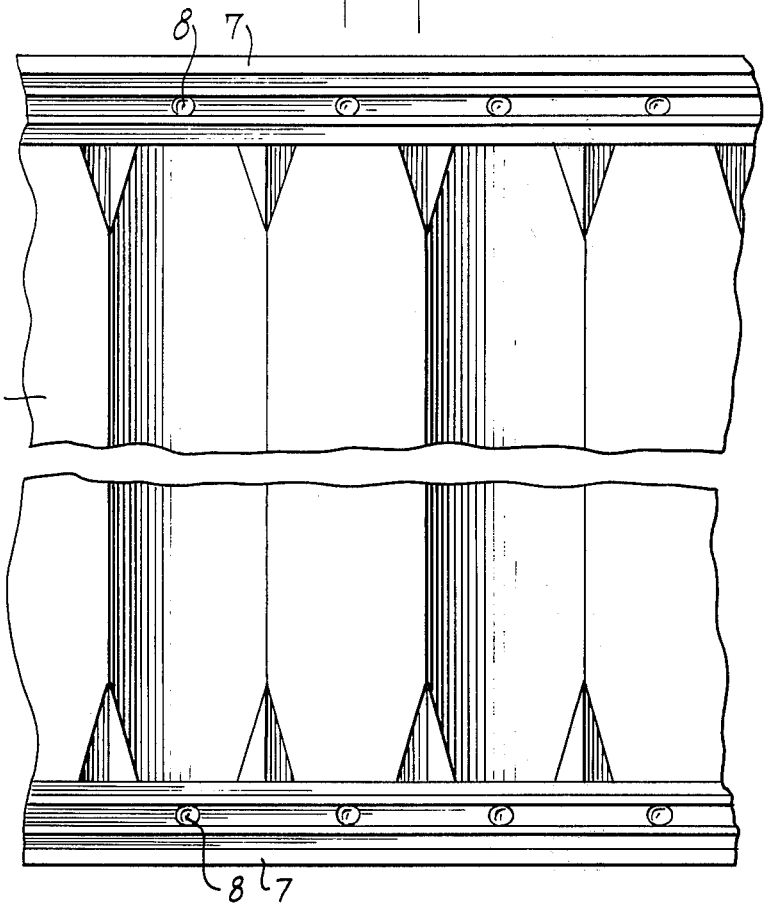
FIG. 7 is a side view of the beam of FIG. 6.
Figure 7:
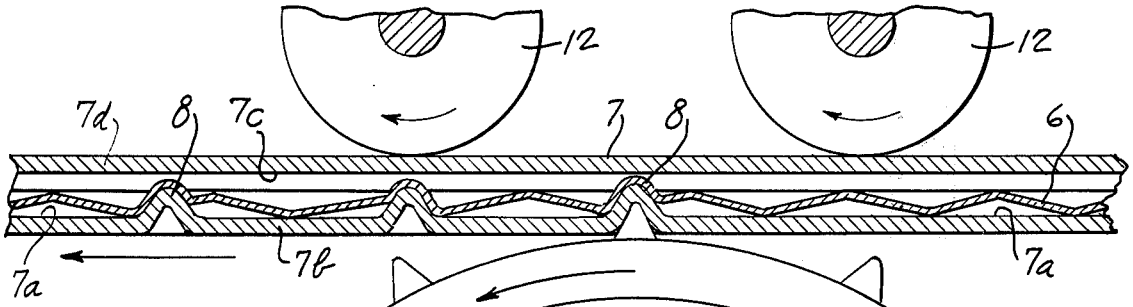
Figure 8:
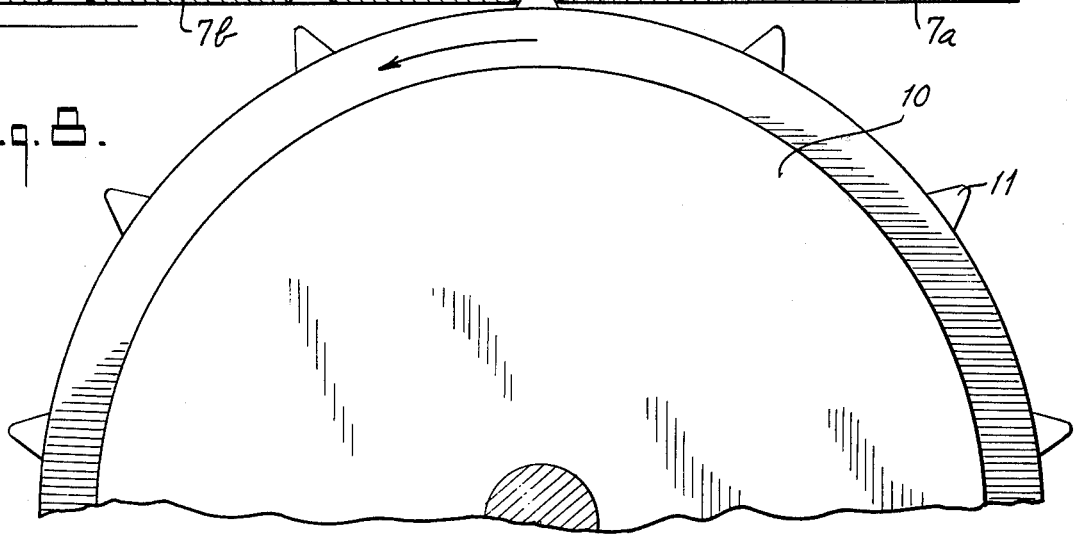
FIG. 8 is a somewhat diagrammatic view, showing apparatus for constructing a joint in either the beam of FIGS. 4 and 5 or the beam of FIGS. 6 and 7.

This figure shows a method and apparatus for constructing the beams shown in FIGS. 4 and 5 and in FIGS. 6 and 7. A corrugated web 6 has its margin inserted in a slot 7*a* in an extruded structural member 7. The assembly is then passed between a wheel 10 having spaced teeth 11 in its periphery and a pair of back-up wheels 12 which hold the member 7. The teeth 11 periodically deform a leg 7*b* of the member 7, forcing a part of that leg 7*b* and a part of the web 6 into a recess 7*c* formed in an opposite wall 7*d* of the member 7. This deformation is illustrated at 8.

FIGS. 9–10

These figures illustrate a different form of web structure, shown generally at 14 in which the pitch P of the deeper corrugations 14*a*, 14*b* is six times the pitch *p* of the shallower corrugations. The deeper corrugations include ridges 14*a* and valleys 14*b*. Each ridge 14*a* branches at a point 14*c* into a central valley 14*d* and a diverging pair of ridges 14*e*. Each of the ridges 14*e* branches again at a point 14*f* into a central valley 14*g* and a pair of ridges 14*h*.

In a somewhat but not exactly similar fashion, each of the valleys 14*b* branches at a point 14*k* into a central ridge 14*m* and a pair of diverging valleys 14*n*. The central ridge 14*m* further branches into a central valley 14*o* and a pair of diverging ridges 14*p*. Pitch P of the step corrugations 14*a*, 14*b* is six times the pitch *p* of the shallower corrugations, as those corrugations are measured at the edge of the web. Furthermore, the depth D of the corrugations in the middle of the web is approximately six times the depth *d* of the corrugations at the edge of the web. Again, the approximateness of the ratio of the depths as compared to the more exact ratio of the pitches is occasioned by the thickness of the material.

Figure 9:
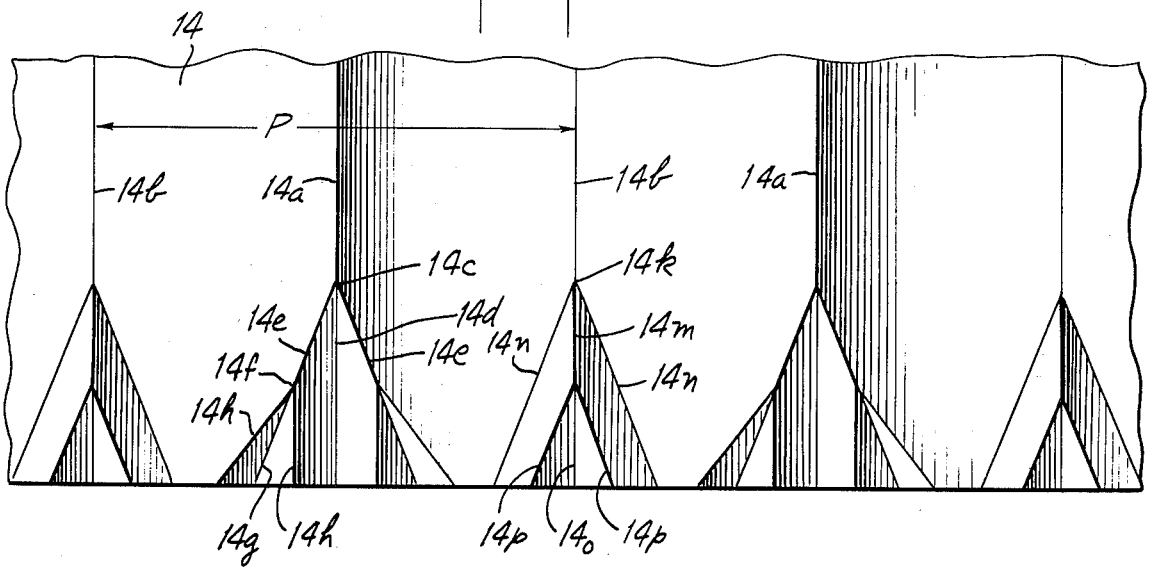
FIG. 9 is a fragmentary plan view of part of a modified form of corrugated web suitable for use in constructing beams in accordance with the invention.
Figure 10:
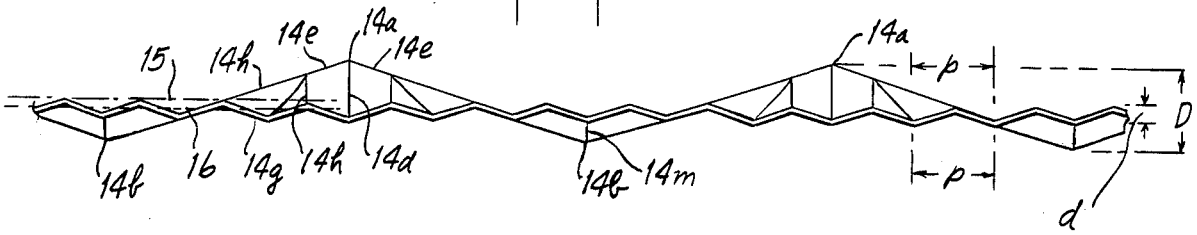
FIG. 10 is an elevational view of the web of FIG. 9.

It may be seen that the contours shown in FIGS. 9 and 10 will provide an even greater ratio of depth between the deep corrugations and the shallow corrugations and hence even greater strength and a resistance to bending of the web for a given width of the slot in the extruded structural members into which the margins of the web are to be inserted.

As a further modification, the points of divergence 14*f* may be relocated in either direction along the ridge 14*e*, for example, even to coincidence with the points 14*c*. (See FIGS. 15–16) In that event, none of the ridges 14*h* would be parallel to the valleys 14*b*. The ends of the ridges 14*h* at the edges of the web would be at the same locations where they appear in FIGS. 9 and 10.

The median plane of the web is shown at 15. The median plane of the shallow corrugations at the edge of the web is shown at 16. Note that the median plane of the shallow corrugations is offset from the median plane of the deeper corrugations. This offset is not usually desirable, although it may be desirable in some cases. It can always be tolerated, if it is not too great.

Comparing the embodiment of FIGS. 9 and 10 with the embodiment of FIGS. 1–3, it is noted that the pitch P and depth D of the deeper corrugations are uniform in both embodiments. Furthermore, the pitch *p* and the depth *d* of the shallower corrugations are also uniform in both embodiments. The deeper corrugations are symmetrical with respect to a median plane (9 in FIGS. 1–3, 15 in FIGS. 9–10). In FIGS. 1–3, the shallower corrugations, as viewed at the edge of the web, are symmetrical with respect to the same median plane 9 as the deeper corrugations. In FIGS. 9–10, the shallower corrugations are symmetrical with respect to a different median plane 16, offset from but parallel to the plane 15. Such an offset occurs whenever the pitch P and depth D are even multiples of the pitch *p* and depth *d*.

FIGS. 11, 12 AND 13

Figure 11:
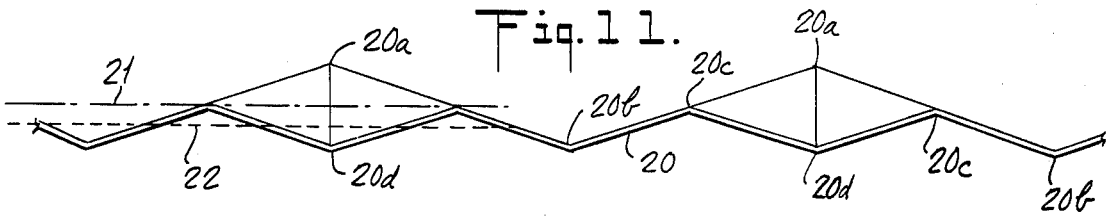
FIGS. 11, 12 and 13 are views similar to FIG. 10, showing modifications.

FIG. 11 shows a web 20 having deep corrugations characterized by ridges 20*a* and valleys 20*b*, and shallow corrugations characterized by alternate ones of the valleys 20*b*, ridges 20*c* and valleys 20*d*, the latter being aligned with the ridges 20*a*. The ratio of the uniform pitch distances and uniform depths of the deeper corrugations to the pitch distance of the shallower corrugations in this modification is two. The median plane of symmetry of the deeper corrugations is shown at 21 and the median plane of symmetry of the shallower corrugations, as viewed at the edge of the web, is offset therefrom, as shown at 22.

Figure 12:
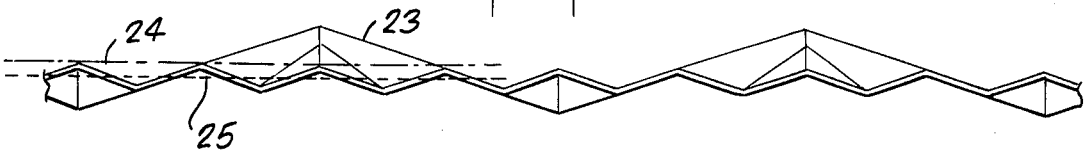

FIG. 12 shows a web 23 having a pitch ratio of four between the deeper corrugations and the shallower corrugations. Note that the median plane 25 of the shallower corrugations is offset from the median plane 24 of the deeper corrugations.

Figure 13:
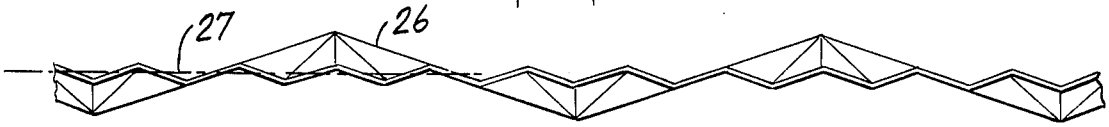

FIG. 13 shows a web 26 having a pitch and depth ratio of five between the deeper corrugations and the shallower corrugations. Note that the median plane 27 of the deep corrugations is also the median plane of the shallow corrugations.

When the pitch and depth ratio is an odd number, as in FIGS. 1–3 and 13, the median plane of the deeper corrugations coincides with the median plane of the shallow corrugations. When the pitch ratio is an even number, the median plane of the shallow corrugations is offset from the median plane of the deep corrugations. As the pitch ratio increases, this offset decreases. The offset is greatest for the pitch ratio of two, shown in FIG. 11, and the smallest offset shown is for the pitch ratio of six (FIG. 10).

Uniform pitches and depths are usually desirable, but are not essential, in that corrugations which are non-uniform and non-symmetric may be used.

FIG. 14

This figure shows a cross-sectional view taken on the line 14—14 of FIG. 1. It may alternatively be regarded as an elevational view taken from the edge of the web where the corrugations are formed as they appear along the line 14—14 of FIG. 1. In other words, it may be regarded as an elevational view of the web 1 of FIG. 1, with part of the shallow corrugated margins trimmed off along the lines 14—14. Such a web could, of course, be constructed by making the corrugations of the form shown in FIG. 14 in the first place, rather than making the web as shown in FIG. 1 and then trimming the edges.

Figure 14:
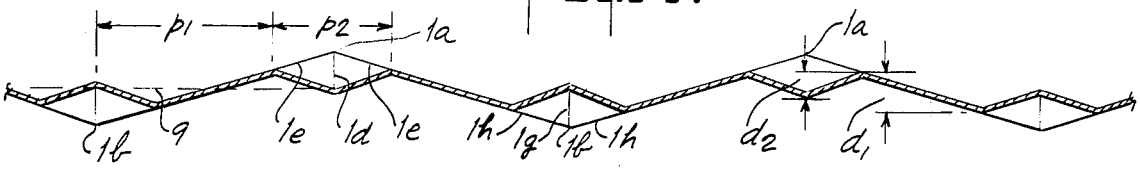
FIG. 14 is a cross-sectional view taken on the line 14—14 of FIG. 1.

The deeper corrugations 1*a*, 1*b*, in FIG. 14 are the same as they appear in FIG. 1. They are uniform in pitch, uniform in depth, and are symmetrical with respect to a median plane 9. The shallower corrugations, however, are not uniform in pitch, and not uniform in depth. Furthermore, no two successive corrugations are symmetrical with respect to any median plane.

Considering the first peak-to-peak corrugation appearing at the left end of FIG. 14, it may be seen that it has a pitch of $p_1$. The next peak-to-peak corrugation has a pitch of $p_2$ which is substantially smaller than $p_1$. It may be seen that these pitch values alternate in successive corrugations along the length of the web.

The depth of the corrugations also alternate between a larger depth $d_1$ and a smaller depth $d_2$. These depths also alternate in successive corrugations along the length of the web.

The structure shown in FIG. 14 is not the optimum embodiment of the invention, since it requires a slot width greater than $d_2$ to receive the edge of the web. Nevertheless, it is entirely practical, particularly if the nonuniformities in the pitches and depths of the shallower corrugations are less marked than those selected for illustration in FIG. 14.

FIGS. 15 AND 16

Figure 15:
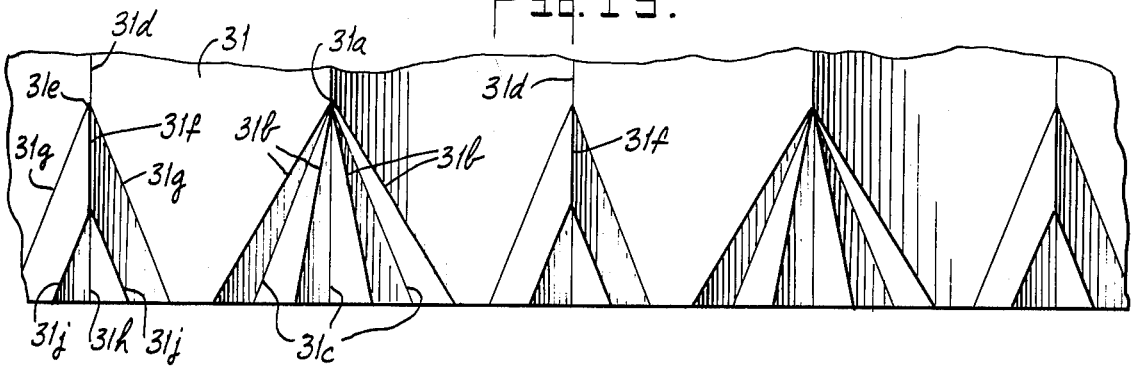
FIG. 15 is a view similar to FIG. 9, illustrating a different embodiment of a corrugated web suitable for use in accordance with the invention.
Figure 16:
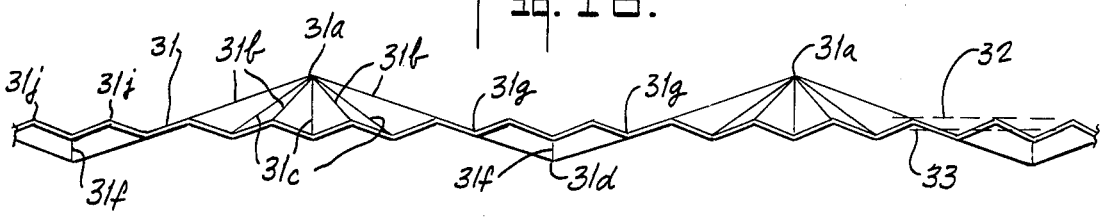
FIG. 16 is an elevational view of the web of FIG. 15.
Figure 17:
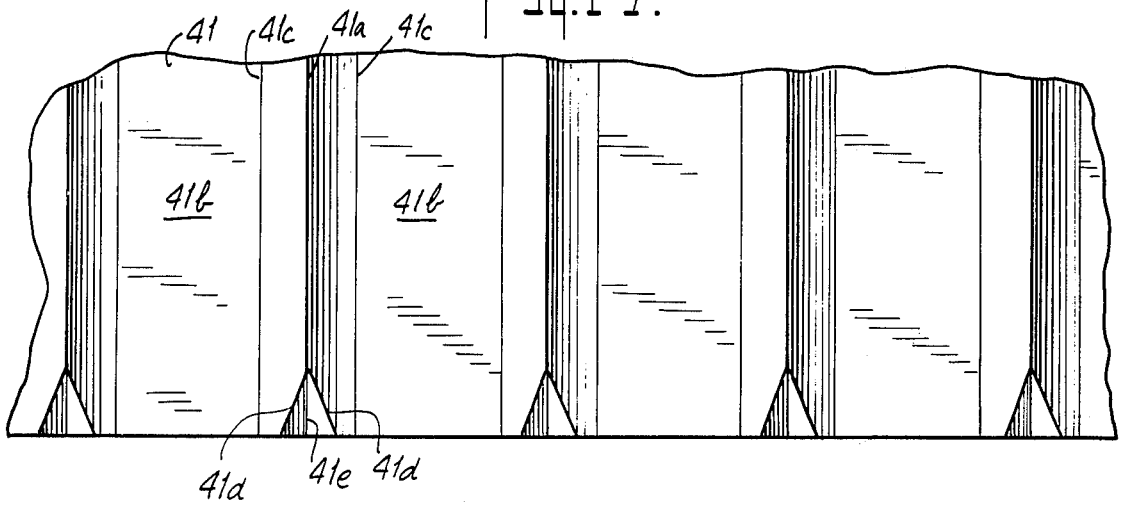
FIG. 17 is another view similar to FIGS. 9 and 15, showing another embodiment of a corrugated web suitable for use in accordance with the invention.
Figure 18:
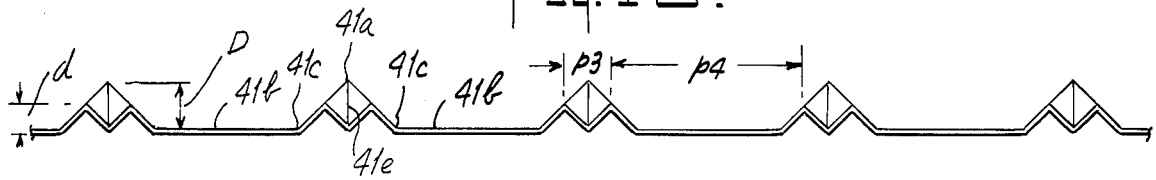
FIG. 18 is an elevational view of the web of FIG. 17.

These figures illustrate a web constructed as a modification of the web 14 of FIGS. 9 and 10. The web 31 shown in FIGS. 15 and 16 is modified as suggested in connection with FIGS. 9 and 10 by relocating some of the points of divergence of the shallower corrugations, so that they coincide at the points 31*a*. It may be seen that three complete corrugations diverge from each point 31*a*. These corrugations include four peaks 31*b* and three valleys 31*c*. The valleys 31*d* of the deeper corrugations have two points of divergence. At the point 31*e*, the deep valley 31*d* branches into a central ridge 31*f* and two valleys 31*g*. Nearer the edge of the web the ridge 31*f* branches again into a valley 31*h* and two ridges 31*j*.

As in the case of FIGS. 9 and 10, the deeper corrugations are uniform as to pitch and depth. The shallower corrugations are also uniform as to pitch and depth. The ratio of the pitch of the deeper corrugations to the pitch of the shallower corrugations is six. The deeper corrugations are symmetrical about a median plane 32. The shallower corrugations are symmetrical about a different plane 33, parallel to the plane 32.

FIGS. 17 AND 18

These figures illustrate a web which may be used in an embodiment of the invention in which the pitch of the deeper corrugations is uniform and their depths are uniform but the corrugations are not symmetrical about any median plane. As to the shallower corrugations, their depths are uniform, their pitch is not uniform and they are not symmetrical about any median plane. In these figures, a web 41 is corrugated by peaks 41*a* rising from flat planes 41*b*. Folds 41*c* separate the planes 41*b* from the sides of the peaks 41*a*. The shallower corrugations are formed by inverting each peak 41*a* near its ends to form a central valley 41*e* and two diverging ridges 41*d*.

It may be seen that the pitch of one set of alternate shallow corrugations is $p_3$ and the pitch of the intervening set of shallow corrugations is $p_4$, much greater than $p_3$. The depth of the shallow corrugations is shown at *d* and the depth of the deeper corrugations is shown at D.

This modification of the invention is entirely practical, although its lateral strength to resist bending is not as great as that of the embodiment shown in FIGS. 1–3, for example.

I claim:

1. A beam, including:

a. an elongated, relatively flexible, transversely corrugated web (1,2,6);

b. two elongated, relatively rigid, structural members, (3,4,7), each member having a slot (3*c*,4*c*,7*a*) receiving one margin of said web;

c. said corrugated web comprising primary corrugations (1*a*,1*b*), each having a depth greater than the width of the slot and extending transversely across the middle (2*n*) of the web, said primary corrugations enhancing the stress resistance of the web, and relatively shallow secondary corrugations (1*d*,1*e*,1*g*,1*h*) extending transversely across each margin from the edge of the web to a juncture with the primary corrugations, said shallow corrugations having a depth which increases gradually from a minimum at the edge of the web to a maximum at said juncture, said minimum depth being smaller than the width of the slots, to facilitate movement of the margins into the slots; and d. means (5) fastening each margin of the web in its associated slot, to lock the members and the web together in a unitary beam.

2. A beam as in claim 1, in which the central plane of the corrugated web is a developable surface.

3. A beam as in claim 1, in which the corrugations are formed by bending an initially flat web, substantially without stretching any part thereof, so that the central plane of the corrugated web is a developable surface.

4. A beam as in claim 1, including only two rigid members and a single web, said slots being substantially on the center lines of said members.

5. A beam as in claim 1, in which:

a. both the shallow and deep corrugations include alternate ridges and valleys;

b. the ridge-to-ridge pitch P of the deep corrugations is *n* times the ridge-to-ridge pitch *p* of the shallow corrugations at the edges of the web; and c. the ridge-to-valley depth D of the deep corrugations is substantially *n* times the ridge-to-valley depth of the shallow corrugations *d* at the edge of the web;

d. where *n* is any integer greater than one.

6. A beam as in claim 1, in which:

a. each said member includes a longitudinal wall (3*b*, 4*b*) and a longitudinally extending leg (3*a*, 4*a*) opposed to and spaced from said wall, said wall and leg cooperating to define said slot;

b. each said wall has an elongated recess (7*c*) extending lengthwise of the surface facing the opposed leg; and c. said fastening means comprises portions of said leg and said web deformed into said recess.

7. A beam, including:

a. an elongated, relatively flexible, transversely corrugated web (1,2,6) having two margins (1*k*,2*k*), a middle region (1*n*,2*n*) and two transitional regions (1*m*,2*m*) between the margins and the middle region;

b. two elongated, relatively, rigid, structural members (3,4,7), each member having a slot (3*c*,4*c*,7*a*) receiving one margin of said web;

c. said corrugated web comprising:

1. primary corrugations (1*a*,1*b*), each having a depth greater than the width of the slot and extending across the middle region, said primary corrugations enhancing the stress resistance of the web;

2. relatively shallow secondary corrugations (1*d*,1*e*,1*g*,1h) extending across the margins, said shallow corrugations having a depth which increases gradually from a minimum at the edge of the web, said depth being smaller throughout said margins that the width of the slots, to facilitate movement of the margins into the slots; and 3. said transitional regions having corrugations with depths which increase gradually from the margin toward the middle region; and d. means (5) fastening each margin of the web in its associated slot, to lock the members and the web together in a unitary beam.

8. A beam as in claim 7, in which the folds of the shallower corrugations branch from the folds of the deeper corrugations in groups, each branching group including a central fold inverted with respect to the fold from which it branches and two diverging folds similar to contour to the fold from which they branch, all of said folds of the shallower corrugations extending from a fold of a deeper corrugation toward the median plane of the corrugated web.

9. A beam of hollow polygonal cross-section, including:

a. two elongated, relatively flexible, transversely corrugated webs (1,2), each corrugation comprising a peak fold and a valley fold;

b. two elongated, relatively rigid, structural members (3,4), each member having:

1. two laterally spaced longitudinally extending slots (3c,4c), each slot receiving one margin (1k,2k) of one of said webs;

c. at least one of said webs comprising primary corrugations (1a,1b) in the middle of the web deeper than the width of the slots to provide stress resistance, and secondary corrugations (1d,1e,1g,1h) in the margins 1k) of the web and shallower at least at the edges of the web than the width of the slots to facilitate movement of the margins into the slots; and d. means fastening each margin of each web in its associated slot, to lock the members and the webs together in a unitary beam.

10. A beam as in claim 9, in which the cross-section is rectangular, comprising:

a. only two of said webs, both of which are corrugated;

b. only two of said structural members, each having two parallel walls.

11. A beam as in claim 9, in which said structural members are extruded aluminum, and said webs are sheet aluminum.

12. A beam as in claim 9 in which:

a. each said member includes two spaced longitudinal walls and two longitudinally extending legs, respectively opposed to and spaced from each of said walls, each said wall and opposed leg cooperating to define one of said slots;

b. each said wall having an elongated recess extending lengthwise of the surface facing the opposed leg; and c. each said fastening means comprises portions of its associated leg and web deformed into said recess.

13. A beam as in claim 9, in which:

a. both the shallower and deeper corrugations include alternate ridges and valleys;

b. the ridge-to-ridge pitch of the deeper corrugations is $n$ times the ridge-to-ridge pitch of the shallower corrugations at the edges of the web; and c. the ridge-to-valley depth of the deeper corrugations is substantially $n$ times the ridge-to-valley depth of the shallower corrugations at the edge of the web;

d. wherein $n$ is any integer greater than one.

14. A beam as in claim 13, in which the folds of the shallower corrugations branch from the folds of deeper corrugations in groups, each branching group including a central fold inverted with respect to the fold from which it branches and two diverging folds similar in contour to the fold from which they branch, all of said folds to the shallower corrugations extending from a fold of a deeper corrugation toward the median plane of the corrugated web.

15. A beam as in claim 9, in which both the shallower and deeper corrugations include alternate ridges and valleys, and at least some of the deep corrugations are aligned at each end with shallow corrugations.

16. A beam as in claim 15, in which the deeper corrugations have a pitch of three times the pitch of the shallower corrugations, each deep ridge is aligned at each end with a shallow valley, and each deep valley is aligned at each end with a shallow ridge.

* * * * *